US006881917B2

(12) United States Patent
Kikukawa et al.

(10) Patent No.: US 6,881,917 B2
(45) Date of Patent: Apr. 19, 2005

(54) VACUUM SWITCHGEAR

(75) Inventors: Shuuichi Kikukawa, Hitachi (JP); Yasuaki Suzuki, Hitachi (JP); Masato Kobayshi, Hitachi (JP); Tooru Tanimizu, Hitachi (JP); Takuya Miyo, Hitachi (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 10/817,832

(22) Filed: Apr. 6, 2004

(65) Prior Publication Data

US 2004/0256360 A1 Dec. 23, 2004

Related U.S. Application Data

(63) Continuation-in-part of application No. 10/303,803, filed on Nov. 26, 2002, now abandoned.

(30) Foreign Application Priority Data

Apr. 16, 2002 (JP) ..... 2002-113153

(51) Int. Cl.[7] ..... H01H 33/66
(52) U.S. Cl. ..... 218/120; 218/7; 218/154
(58) Field of Search ..... 218/118, 134, 218/139, 119, 154, 120, 140, 2–14, 55, 67, 78–80

(56) References Cited

U.S. PATENT DOCUMENTS

| | | | | |
|---|---|---|---|---|
| 4,527,028 A | * | 7/1985 | Luehring | 218/119 |
| 6,144,005 A | | 11/2000 | Tanimizu et al. | |
| 6,259,051 B1 | * | 7/2001 | Tanimizu et al. | 218/120 |
| 6,268,579 B1 | * | 7/2001 | Kajiwara et al. | 218/153 |
| 6,335,502 B1 | | 1/2002 | Kikukawa et al. | |
| 6,498,314 B1 | | 12/2002 | Miyo et al. | |

FOREIGN PATENT DOCUMENTS

| | | |
|---|---|---|
| JP | 2000-268685 | 9/2000 |
| JP | 2000-268686 | 9/2000 |

* cited by examiner

*Primary Examiner*—Elvin Enad
*Assistant Examiner*—M. Fishman
(74) *Attorney, Agent, or Firm*—Mattingly, Stanger, Malur & Brundidge, P.C.

(57) ABSTRACT

Disclosed is a vacuum switchgear wherein a ground switch, a load switch, and an external connecting conductor to be electrically connected with the inside and outside of the vacuum container are provided in a vacuum container; the ground switch and the external connecting conductor are electrically connected in the vacuum container; and the vacuum container has a joint construction of a body portion having openings on both ends thereof, and a lid joined to the opening of the body.

8 Claims, 6 Drawing Sheets

VACUUM SWITCHGEAR

This is a continuation-in-part application of U.S. Ser. No. 10/303,803, filed Nov. 26, 2002 now abandoned. The entire contents of this application is hereby incorporated by reference.

BACKGROUND OF THE INVENTION

1. Field of the Invention

This invention relates to a novel vacuum switchgear with a simplified structure that can be fabricated with great ease at low cost.

2. Description of the Related Art

A vacuum switchgear having a construction of a plurality of switches in a vacuum container is disclosed in, for example, JP-A-2000-268685 and JP-A-2000-268686. Though the constructions in which a plurality of switches are accommodated in the vacuum container are disclosed, detailed structure and construction of the vacuum container are not stated at all in these publications.

When accommodating the plurality of switches in the vacuum container, assembling process of the internally located parts of these switches becomes complex and difficult as an increase in the number of parts. Further, when the plurality of switches are accommodated in a single vacuum container, the configuration of the vacuum container becomes larger and complex.

SUMMARY OF THE INVENTION

It is an object of this invention to provide a vacuum switchgear in which the assembling efficiency of the parts to be accommodated in the interior of the vacuum container is improved, the configuration of the vacuum container is simplified, and the parts to be accommodated in the interior of the container can be assembled easily. Thus, the vacuum switchgear can be fabricated at low cost.

The present invention provides a vacuum switchgear comprising;

a vacuum container being electro-conductive;

a cylindrical body having openings at both ends thereof, a diameter of said openings being nearly the same as that of said diameter of the cylindrical body;

a ground switch having a movable electrode and a fixed electrode;

at least one switch having a movable electrode and a fixed electrode, wherein the switch functions as any one of a load switch for turning on and off an operating current, a circuit breaker for shut-off in case of an accident and a disconnector for switching circuits; and external connecting conductors to be electrically connected to the outside of the vacuum container, wherein said ground switch, said switch and said conductors are accommodated in said vacuum container;

said ground switch, and said external connecting conductors are electrically connected in said vacuum container; and said openings of said cylindrical body being air-tightly sealed with a pair of lids to constitute the vacuum container, the lids being welded to the cylindrical body after assembly and inspection of the parts in the vacuum container. The diameter of the lids is nearly equal to the diameter of the cylindrical body so that the assembly work and inspection work can be carried out with great ease. The lids have a diameter that is almost same as that of the openings. The openings have the same diameter as that of the cylindrical body as shown in FIG. 1*b*. The cylinder body is preferably made of an electro-conductive material or an electro-conductive coating is applied to the portion or the whole outer or inner surface of the vacuum container. As a result, the vacuum container is grounded in installing it at the sis, and operators can work or conduct his or her job with safety.

DESCRIPTION OF THE INVENTION

Figure 1A:
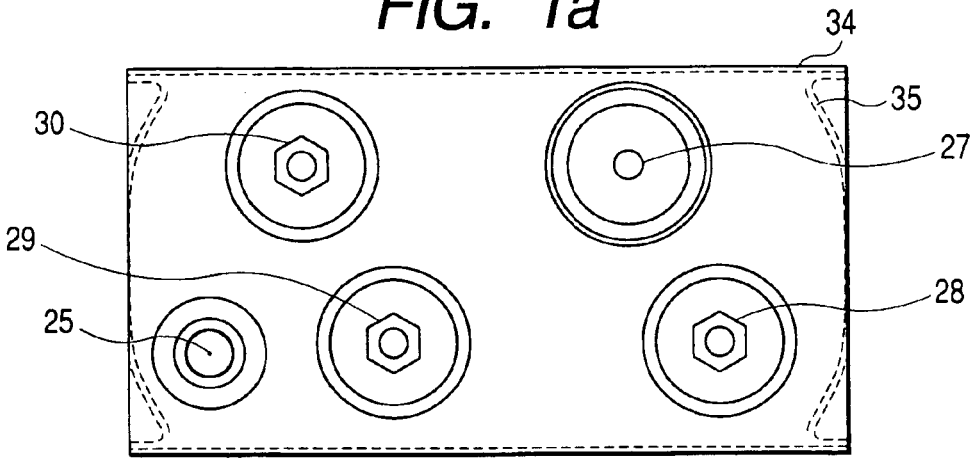
FIG. 1*a* is a plan view of a vacuum switchgear according to Embodiment 1 of this invention.

The present invention also provides the vacuum switchgear, wherein the switch includes at least two of a load switch, a circuit breaker and a disconnector, whereby each of the switch functions as its switch.

The present invention also provides the vacuum switchgear, wherein the cylindrical body of the vacuum container is press-shaped or plastic molding into a desired shape with great ease.

The present invention further provides the vacuum switchgear, wherein the cylindrical body of the vacuum container is constructed by a plurality of divided cylindrical bodies, and the bodies are arranged side by side, the adjoining cylinder bodies being united by welding.

According to this invention, the assembling efficiency of the parts to be accommodated in the interior of the vacuum container is improved by opening both ends of the vacuum container before assembling the parts, and the configuration of the vacuum container is simplified and assembly of the parts to be accommodated in the container may be facilitated by dividing the cylindrical body of the vacuum container into a plurality of pieces and assembling the same into a unit, whereby a highly reliable vacuum switchgear is provided with great ease.

In this invention, the vacuum circuit breaker portion includes required structure for performing vacuum circuit breaker, that is, a movable electrode, a fixed electrode, a conductor for supporting them, an insulator isolating the movable electrode and the fixed electrode, and a vacuum container for accommodating them. The disconnecting switch portion is a device connected to the shutoff portion for holding the circuit breaker in the disconnected state as needed, and includes the vacuum container for accommodating these elements.

The positioning of electrode contacts of the electrodes or parts in the vacuum container can be viewed or observed through the openings.

In this invention, the vacuum container accommodating a plurality of circuits is preferably provided with a working space for assembling the plurality of switches or parts in the vacuum container. The assembled switches and parts, and particularly electrode switches of the movable contacts or fixed contacts are inspected with ease. If there is any dislocation, or mismatching of the contacts, they are corrected or adjusted with great ease, because of large openings in size. Accordingly, in this invention, the vacuum container is constructed in such a manner that a cylindrical body where parts are assembled and a pair of lids for air-tightly sealing the openings at both ends of in the vacuum container. As a consequent, assembling efficiency in the interior of the vacuum container is improved, and the assembled state of the internal parts can be inspected, whereby a highly reliable vacuum switchgear is obtained.

Further, in this invention, since the openings of the vacuum container are air-tightly joined with lids by welding, and when the lids are welded after the parts in the vacuum container are assembled, followed by soldering, the already soldered locations are not heated at all, when welding the lids to the cylindrical body, thereby improving reliability of the soldered portions.

In addition, in this invention, the vacuum container is constructed of a plurality of divided cylindrical bodies that are divided into several segments of the cylindrical bodies in the direction of the axis thereof and are joined with each other by welding. Since plastic forming of the cylindrical body or divided cylindrical bodies is conducted easily, the production cost of the vacuum container can be lowered. Furthermore, if all of the divided container segments are made in the same configurations, the number of types of the parts is reduced and thus misassembling is avoided.

In other words, this invention provides the vacuum switchgear in which a ground switch (14, 15), a load switch (10, 11, 12, 13) and an external connecting conductor to be electrically connected to the inside and the outside of the vacuum container are provided in the vacuum container, and the ground switch and the external connecting conductor are electrically connected in the vacuum container, wherein the vacuum container has a cylindrical body portion having openings at both ends thereof, and the lids joined to the opening; and the electrode of at least one of the ground switch and the load switch are located so that the respective contact portions can be viewed through the openings during assembly, inspection and adjusting. This invention also provides the vacuum switchgear wherein the vacuum container has a cylindrical body having openings and lids joined to the openings by welding. The vacuum container has such a construction that the wall surfaces except for the wall surface to which each of the electrodes of at least one of the ground switch and the load switch is connected are curved out. The vacuum container has a cylindrical body formed from a metallic tube and having openings at both ends and an installing portion for installing the vacuum container that is plastic-formed into a desired shape so that the electrodes of at least one of the ground switch and another switch, such as a load switch, a circuit breaker or a disconnector switch can be installed except at the opening.

Further, this invention provides a vacuum switchgear wherein the vacuum container has a body portion having openings at both ends and lids that are welded to the peripheral portions of the openings of the cylindrical body. The movable electrode of at least one of the ground switch and the load switch are moved by bellows, and the bellows are inserted and joined into a recess formed on the upper surface of the body portion; the movable electrode of the ground switch in the vacuum container is insulated from the vacuum container and electrically connected to the movable rod connected to the outside, and the fixed electrode of the ground switch in the vacuum container is insulated from the vacuum container and electrically connected to the connecting conductor that is in turn connected to the outside of the vacuum container; or the fixed electrode of the load switch is insulated in the vacuum container and electrically connected to the connecting conductor that is in turn connected to the outside of the vacuum container.

Furthermore, this invention provides a vacuum switchgear wherein the fixed electrode of the ground switch and the fixed electrode of the load switch are integrally connected by a flat conductor in the vacuum container; the fixed electrode of the ground switch and the fixed electrode of the load switch are integrally connected by the conductor in the vacuum container, and the conductor is insulated in the vacuum container and electrically connected to the connecting conductor that is in turn connected to the outside of the vacuum container; or the vacuum container has a joint construction of the body portion having the openings on both side surfaces of the cylindrical portion and the lid joined to at least one of the openings, and the electrode of at least one of the ground switch and the load switch is connected to the upper and lower surfaces of the body portion.

Still further, in this invention, the vacuum switchgear has at least the ground switch and the load switch, and the vacuum circuit breaker switch. The vacuum container can be constructed of the plurality of cylindrical body joined at the openings with respect to each other, and the electrode of at least one of the ground switch and the load switch is connected to the upper and lower surface of the body portion; or the vacuum container has a joint made of austenitic steel containing 0.03% or less of C, 18 to 20% of Cr, 9 to 13% of Ni, and 2.0 to 3.0% of Mo by weight. In addition, the austenitic steel preferably contains 1.0% or less, or more preferably, 0.3 to 0.8% of Si, and 2.0% or less, or more preferably, 0.5 to 1.5% of Mn.

Preferably, the vacuum container is joined by welding. Preferably, the vacuum container includes the cylindrical body having openings and the lids for closing the opening, and the lid includes a lug portion bent toward the outside of the vacuum container around the peripheral edge thereof and are joined by welding with the lug portion abutted against the inner peripheral surface of the cylindrical body. Preferably, the vacuum container includes the cylindrical body portion having the openings and the lids for closing the openings, and the lid is an arcuate shape curving out toward the outside of the vacuum container in cross section.

DETAILED DESCRIPTION OF THE PREFERRED EMBODIMENTS

Embodiment 1

Figure 1B:
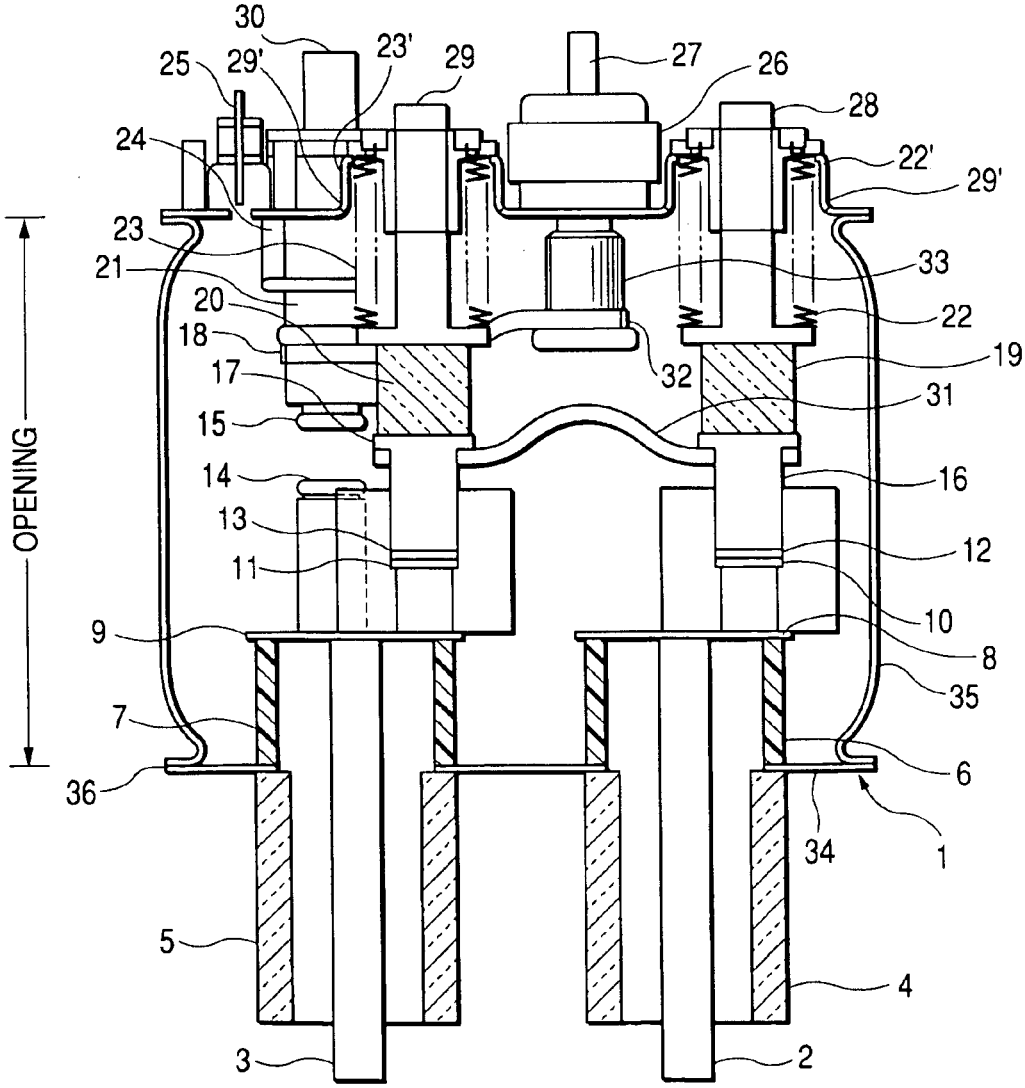
FIG. 1*b* is a cross sectional view showing a construction of the vacuum switchgear according to Embodiment 1 of this invention.

FIG. 1*a* and FIG. 1*b* show a top view and a cross sectional view of the vacuum switchgear according to an embodiment of this invention, respectively. The vacuum container 1, which is electro-conductive and grounded when installed on sites accommodates movable electrodes 12, 13 and the fixed electrodes 10, 11 of two circuit breaker or disconnecting switch and a movable electrode 15 and a fixed electrode 14 of a single ground device portion, and is provided with a vacuum pressure measuring terminal 25 of a vacuum pressure monitoring device mounted on the vacuum container 1. As shown in the top view (FIG. 1*a*), the two circuit breaker portions or disconnecting switch portions being aligned in a row, and a single ground device portion and the external connecting conductor 27 being aligned in a row are arranged in parallel each other.

Most part of the vacuum container 1 is formed of conductive material such as SUS316L (JIS standard), which is nonmagnetic stainless steel having high strength. The vacuum container 1 is grounded. The vacuum pressure of the vacuum container 1 is observed by a vacuum monitor 25. Insulation between the vacuum container 1 and the conductor in the vacuum container is attained by cylindrical insulators 4, 5, 6, 7, 19, 20, 21, 26 formed of sintered ceramics such as alumina, zirconia, and so on.

The external connecting conductor 27, including a central copper conductor portion, an upper metal cap and a lower metal cylindrical body, is attached on the vacuum container 1 by soldering the central copper conductor portion thereto via the cylindrical insulator.

These insulators 4, 5, 6, 7 are joined to the body 34 of the vacuum container 1 by means of solder material containing 70% of Cu and 30% of Mn, and the insulators 6, 7 are connected with conductors 8, 9 formed of copper plate by means of Ag solder of BAg-8. Since a high residual stress is generated by soldering the insulators 4, 5, 6, 7 to the body 34 of the vacuum container 1, a member having high strength and anti-SCC characteristics is used for the vacuum container 1. The configuration of the body 34 of the vacuum container 1 viewed from the side of FIG. 1 coincides with the plane configuration of the lid 35.

In this embodiment, the vacuum container 1 is constructed in such a manner that the body portion 34 is formed of the nonmagnetic stainless steel pipe having openings on both ends or of a plate of the same material formed into a single piece of prescribed configuration as shown in the side view of FIG. 1 by welding, and that the lid 35 provided on the opening is formed of the same nonmagnetic stainless steel plate in a oval shape with the central portion curved outward and in circular arc with a flat central portion in cross section, and is provided with a joining portion 36 bent toward the outside of the vacuum container 1 so as to abut against the inner peripheral surface of the body portion 34 and to be joined by welding. Joining operation is to be performed after each part is installed.

The fixed electrode 10 and the movable electrode 12, the fixed electrode 11 and the movable electrode 13, and the fixed electrode 14 and the movable electrode 15 that can be brought into and out of contact with each other are arranged in the vacuum container 1, and the switch is turned on and off by bringing into and out of contact with each movable electrode by the command of the operating mechanism. The movable electrodes 12, 13, 15 are connected to the movable conductors 16, 17, 18 respectively, which are connected in turn to the movable rod 28, 29, 30 via the insulators 19, 20, 21 respectively, and then to the operating mechanism (not shown). The movable rods 28, 29, 30 are hermetically sealed with the bellows 22, 23, 24 respectively.

The upper surface side of the body portion 34 on which the bellows 22, 23, 24 are mounted is formed with a recess (26) so that the bellows 22, 23, 24 can be elastically provided therein, and with through-holes at the central portion thereof so that the movable rods 28, 29 can be inserted.

The body portion 34 is formed with a through-hole through which the connecting conductors 2, 3 are inserted at the lower portion thereof, and the cylindrical insulators 4, 5, 6, 7 are joined to the inside and outside thereof.

The fixed electrode 10 is connected to the connecting conductor 2 via the conductor 8, and thus is connected to the outside of the vacuum container 1. In the same manner, the fixed conductor 11 is connected to the connecting conductor 3 via the conductor 9, and thus connected to the vacuum container 1. The conductors 8, 9 formed of copper plate constitutes a part of the vacuum container, and are connected to the outside of the vacuum container 1 via the insulators 6, 7 in the vacuum container 1. The connecting conductors 2, 3 are further covered with the insulators 4, 5 outside of the vacuum container 1. The conductor 9 is integrally soldered to the fixed electrode 14 of the ground switch.

The connecting conductor 2 and the connecting conductor 3 that are connected to the outside, being connected via the movable conductor 17, a flexible conductor 31, and the movable conductor 16, are electrically connected when the movable electrode 13 and the movable electrode 12 are in the ON state. The fixed conductor 14 of the grounded portion is electrically connected to the external connecting conductor 27 of the ground terminal portion when the movable electrode 15 of the grounded portion is in the ON-state since the movable conductor 18 is connected to the ground terminal conductor 33 via the flexible conductor 32.

The external connecting conductor 27 has the connecting portion with respect to the flexible conductor 32 and the ground terminal conductor 33 integrally connected with each other, and is insulated from the vacuum container 1 by the insulator 26.

The flexible conductors 31, 32 are arranged in the vacuum container, and thus are formed in such a manner that laminated sheets of oxygen free high conductivity copper (0.1 mm to 0.2 mm) are used for current carrying parts so that they can be operated in vacuum, and stainless steel sheets having layers of oxides and being thinner than the oxygen free high conductivity copper are inserted between the oxygen free high conductivity copper sheets so that oxygen free copper sheets do not adhere to each other in vacuum and its flexible characteristics thereof can be maintained.

The flexible conductors are curved out toward the opposite direction from the current carrying parts so as to secure a distance from the current carrying parts of the main circuit.

In addition, in the present embodiment, the connecting portions of the flexible conductor 32 and the movable conductor 18 of the ground switch are plated with silver, and then the silver plate on the connecting portions is melted at a vacuum soldering temperature during manufacturing of the vacuum container for connecting them with each other. Therefore, flexible conductors may be joined simultaneously with assembling of the vacuum container by soldering, which makes assembling of the vacuum container easy without increasing the number of the process steps.

As is described thus far, according to, the present embodiment, a highly reliable vacuum switchgear may be provided since assembling efficiency of the parts to be accommodated in the interior of the vacuum container is improved, and the configuration of the vacuum container is simplified, and thus the assembly of the parts in the container is facilitated.

In the vacuum switchgear accommodating the ground switch according to the present embodiment, space required for the outside of the vacuum container maybe reduced, thereby realizing a compact vacuum switchgear by connecting the respective ground switches to be accommodated in the interior of the vacuum container, and by providing a single contact terminal that is to be connected with the outside of the vacuum container.

Embodiment 2

Figure 2:
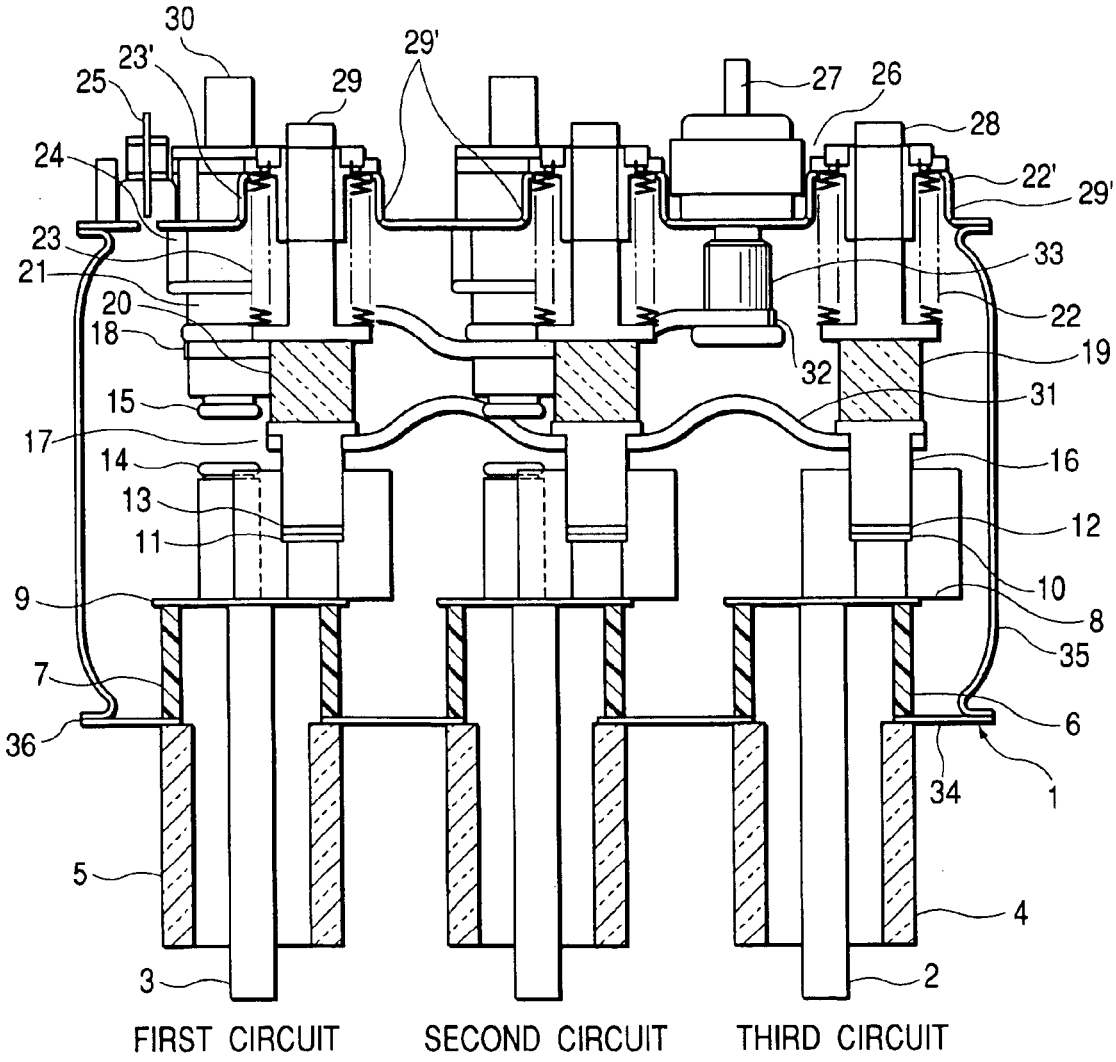
FIG. 2 is a cross sectional view showing a construction of a vacuum switchgear according to Embodiment 2 of this invention.
Figure 3:
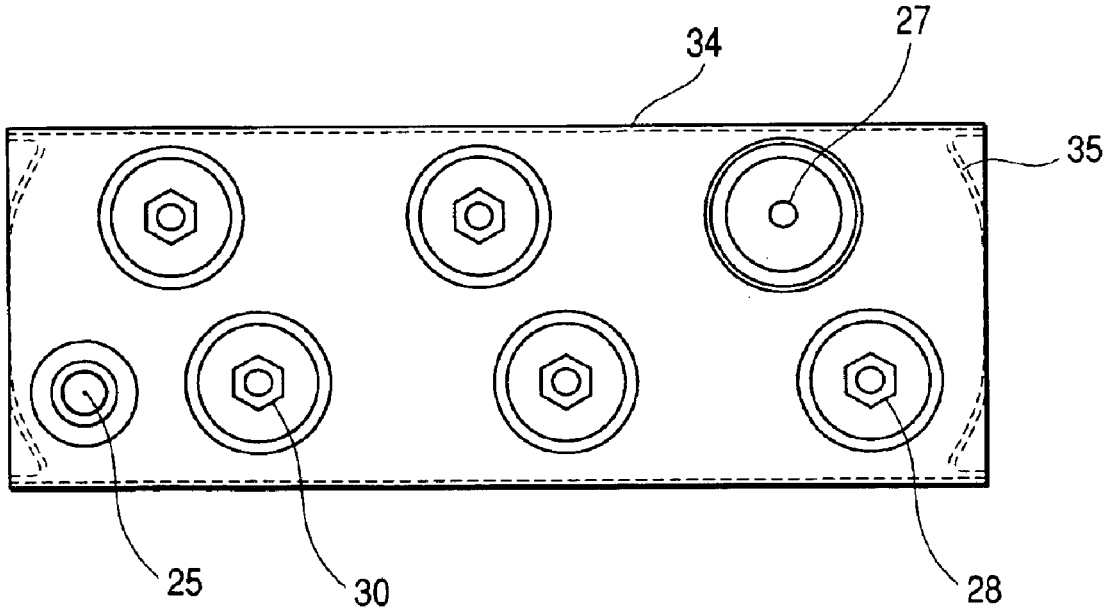
FIG. 3 is a top view showing the switch arrangement of the vacuum switchgear shown in FIG. 2.

FIG. 2 is a cross sectional view of the vacuum switchgear according to this invention, and FIG. 3 is a top view of the vacuum switchgear shown in FIG. 2. In the present embodiment, a set of switches for the shutoff portion or for the disconnecting portion and an additional ground switch having electrode contacts 14', 15' is further accommodated in the vacuum container, and the circuits are connected by the flexible conductors 31, 32 respectively in addition to Embodiment 1 shown in FIG. 1. The basic structure of the present embodiment is the same as that in Embodiment 1, and the method of manufacturing is also the same. Three sets of switches for the shutoff portion or for the disconnecting portion and two sets of ground switches are accommodated in the vacuum container. The former and the latter are arranged in a staggered pattern. The two sets of ground switches are connected to a single integrated external connecting conductor 27 by the flexible conductor 32.

The desired circuits may be electrically connected by turning on and off the movable electrodes of the respective circuits. Since the movable conductors of a first circuit and a second circuit are connected to the ground terminal portion via the flexible conductor 32 in the ground switch, when the movable electrode at the grounded portion of the first circuit is turned on and the movable electrode of the grounded portion of the second circuit is turned off, the first circuit is grounded via the ground terminal portion, and when the movable electrode of the grounded portion of the first circuit is turned off and the movable electrode of the grounded portion of the second circuit is turned on, the second circuit can be grounded. When the movable electrodes of the grounded portions of the first circuit and the second circuit are turned on, both of the first circuit and the second circuit can be grounded via the ground terminal portions.

Also, even when the movable electrode of the grounded portion of the first circuit is turned on and the movable electrode of the grounded portion of the second circuit is turned off, in the case where the movable electrode of the shutoff portion or the disconnecting portion of the first circuit is in the ON state, the second circuit is grounded via the flexible conductor of the shutoff portion or the disconnecting portion. Therefore, there is provided an interlock for turning off the movable electrode of the shutoff portion or the disconnecting portion of the first circuit for preventing input/output operation when the movable electrode at the grounded portion of the second circuit is turned on. Likewise, in the second circuit, there is provided an interlock for turning off the movable electrode of the shutoff portion or the disconnecting portion of the second circuit for preventing input/output operation when the movable electrode of the grounded portion of the second circuit is in the on state.

As is described thus far, according to the present embodiment, a highly reliable vacuum switchgear may be provided since assembling efficiency of the parts to be accommodated in the interior of the vacuum container is improved, and the configuration of the vacuum container is simplified, and thus the assembly of the parts in the container is facilitated.

In the vacuum switchgear accommodating the ground switch according to the present embodiment, space required for the outside of the vacuum container maybe reduced, thereby realizing a compact vacuum switchgear by connecting the respective ground switches to be accommodated in the interior of the vacuum container within the vacuum containe, and by providing the single ground terminal that is connected with the outside of the vacuum container.

Embodiment 3

Figure 4:
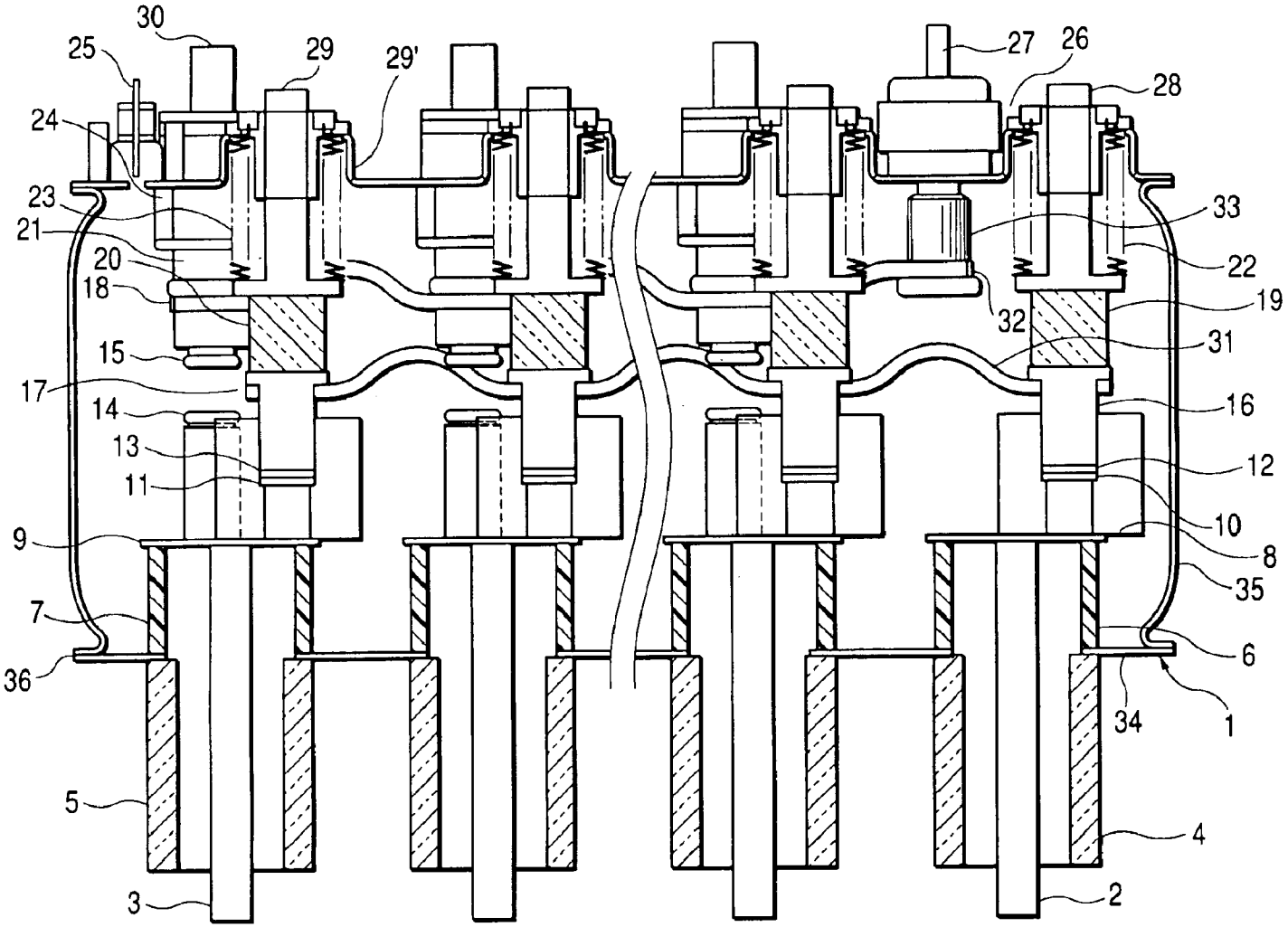
FIG. 4 is a cross sectional view showing a construction of the vacuum switchgear according to Embodiment 3 of this invention.
Figure 5:
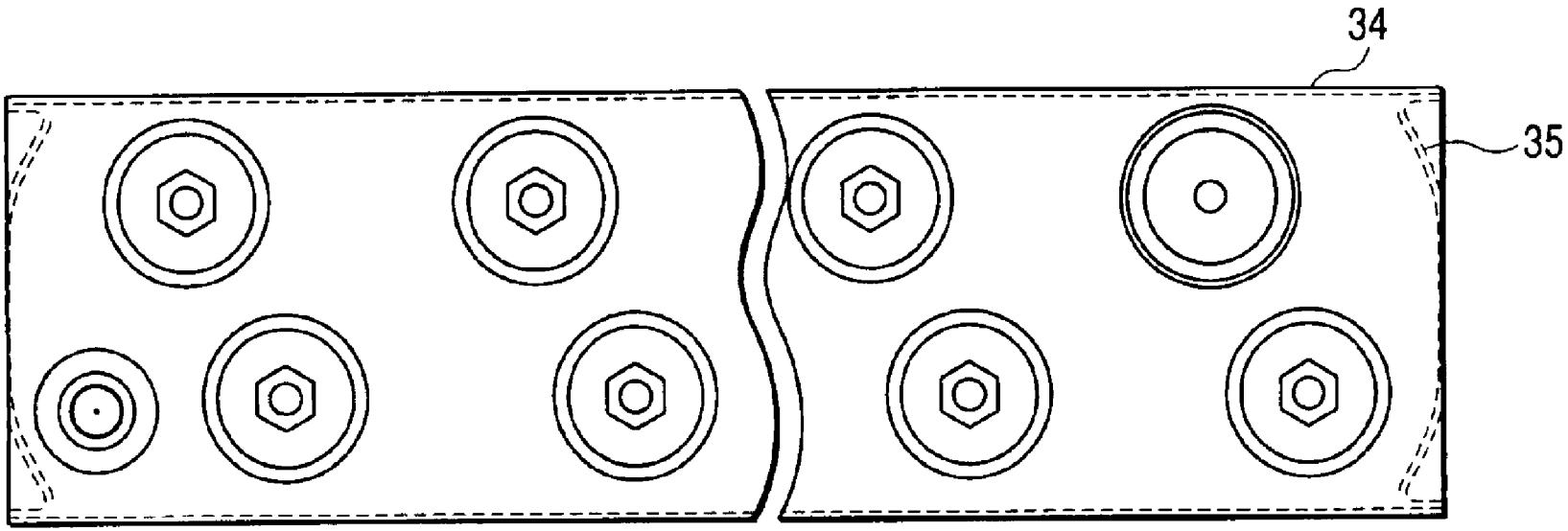
FIG. 5 is a top view showing the switch arrangement of the vacuum switchgear shown in FIG. 4.

FIG. 4 is a cross sectional view of the vacuum switchgear of this invention and FIG. 5 is a top view thereof. The basic structure of the present embodiment is the the same as that of Embodiment 1, and the method of manufacturing is also the same. In the present embodiment, a switch for the shutoff portion or for the disconnecting portion and the ground switch are further accommodated in the vacuum container, and the respective circuits are connected through the flexible conductors 31, 32 respectively in addition to Embodiment 2 shown in FIG. 1. At least four sets of switches for the shutoff portion or for the disconnecting portion and at least three sets of ground switches are accommodated in the vacuum container. The former and the latter are arranged in a staggered pattern.

Likewise, in the vacuum container accommodating at least three circuits as in this embodiment, the desired circuits may be grounded by connecting the respective circuits by the flexible conductor 31, and by turning the electrode of each circuit ON from the single ground terminal via the flexible conductor 31.

As is described thus far, according to the present embodiment, a highly reliable vacuum switchgear may be provided since assembling efficiency of the parts to be accommodated in the interior of the vacuum container is improved, and the configuration of the vacuum container is simplified, and thus the assembly of the parts in the container is facilitated.

In the vacuum switchgear accommodating the ground switch according to the present embodiment, space required for the outside of the vacuum container maybe reduced, thereby realizing a compact vacuum switchgear by connecting the respective ground switches to be accommodated in the interior of the vacuum container, and by providing the single ground terminal that is to be connected with the outside of the vacuum container.

Embodiment 4

Figure 6:
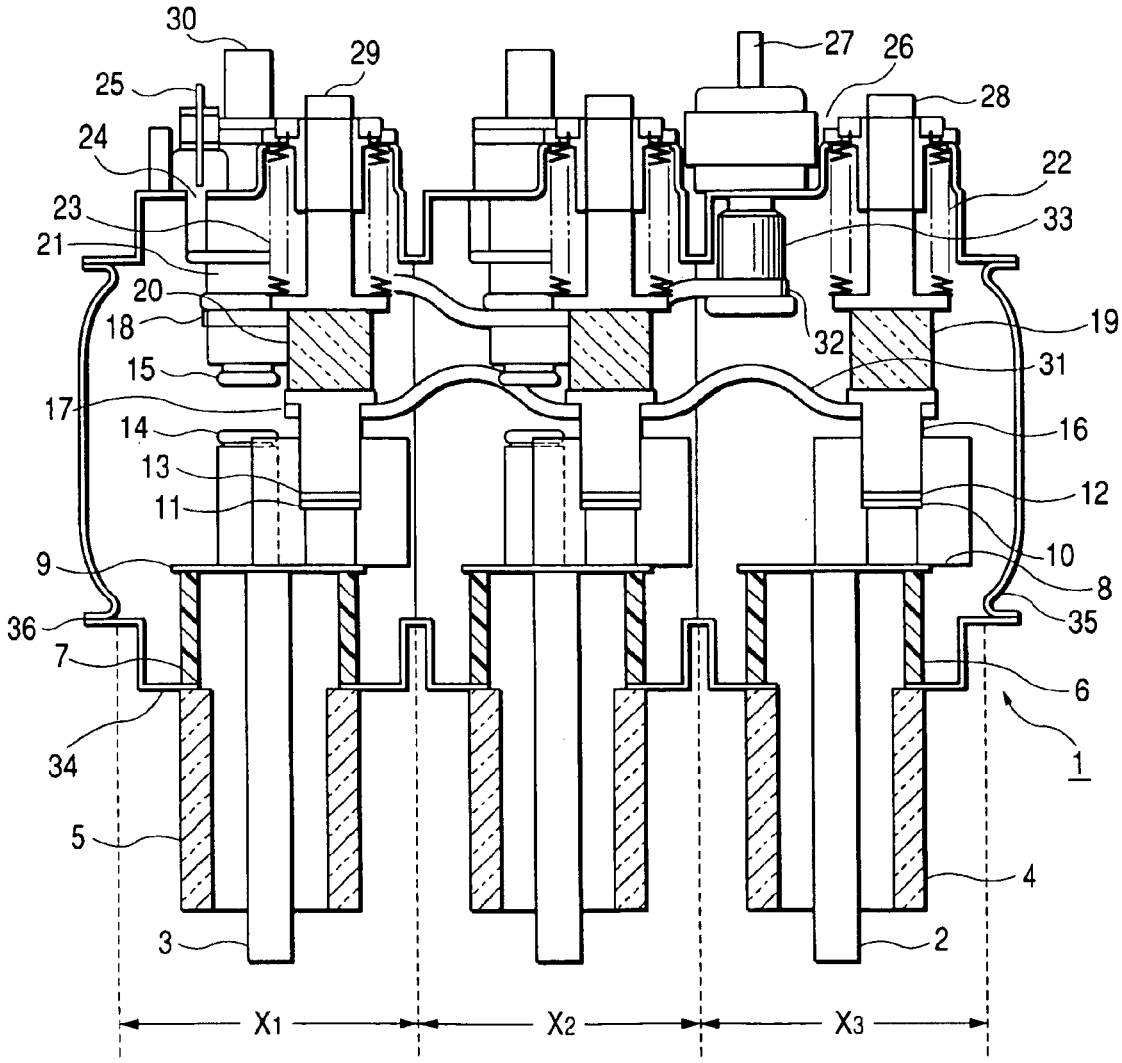
FIG. 6 is a cross sectional view showing a construction of the vacuum switchgear according to Embodiment 4 of this invention.

FIG. 6 is a cross sectional view of the vacuum switchgear of this invention. The basic structure of the present embodiment is the same as that in Embodiment 1, and the method of manufacturing is also the same. Three sets of switches for the circuit breaker or for the disconnector and two sets of ground switch are accommodated in the vacuum container. The former and the latter are arranged in a staggered pattern. The arrangement of the switches for each of the circuits is such that the arrangement of each switch for the shutoff portion or for the disconnector and the arrangement of the ground switch and the external connecting conductor are disposed in parallel with each other. Though the staggered pattern shown in FIG. 1*a* is preferable in order to take a longer insulation distance, it is also possible to dispose them on a grid pattern.

In the vacuum container 1 in the present embodiment, three pieces of SUS 316L steel pipes used in Embodiment 1 are respectively are arranged side-by-side and plastic formed into a square shape in top view. The effective length of each of the segments is the same X1, X2 and X3 as shown in FIG. 6. The outer most segments have a little longer size than the central one. The edges of both sides of the central segment are cut off, thereby to constitute a desired structure of the vacuum container.

The openings are formed on both side surfaces of each formed steel pipe, and the steel pipes are joined at the openings by welding as is at the welding portion 36. Each electrode for the ground switch and for the shutoff portion or for the disconnecting portion is provided with projections 22', 23' for inserting the bellows 22 on the individual steel pipe by plastic-forming the plate of same material as shown in FIG. 6, and a cap formed with a hole for inserting the electrode is joined to the projections. The joint of each electrode is the same as in Embodiment 1. As described above, the lids 35 are joined to the peripheries of the openings by welding after the contacting state of each electrode is inspected through the openings.

As is described thus far, according to the present embodiment, a highly reliable vacuum switchgear may be provided since assembling efficiency of the parts to be accommodated in the interior of the vacuum container is improved, and the configuration of the vacuum container is simplified. Thus the assembly of the parts in the container is facilitated.

In the vacuum switchgear accommodating the ground switch according to the present embodiment, space required for the outside of the vacuum container maybe reduced, thereby realizing t the compact vacuum switchgear by connecting the respective ground switches to be accommodated in the interior of the vacuum container, and by providing the single contact terminal that is to be connected with the outside of the vacuum container.

As is described thus far, according to this invention, a highly reliable vacuum switchgear may be provided since assembling efficiency of the parts to be accommodated in the interior of the vacuum container is improved, and the configuration of the vacuum container is simplified, and thus the assembly of the parts in the container is facilitated.

Further, according to this invention, space required for the outside of the vacuum container may be reduced, thereby realizing a compact vacuum switchgear by connecting the ground switches in the vacuum container, as well as by providing a single ground terminal that is to be connected with the outside of the vacuum container.

What is claimed is:

1. A vacuum switchgear comprising;

a vacuum container;

a cylindrical body having openings at both ends thereof, the body being electro-conductive and to be grounded, diameter of said openings being nearly the same as that of a diameter of the cylindrical body;

a ground switch having a movable electrode and a fixed electrode;

at least one switch having a movable electrode and a fixed electrode, wherein the switch functions as any one of a load switch for turning on and off an operating current, circuit breaker for shut-off in case of an accident and a disconnector for switching circuits; and external connecting conductors to be electrically connected to the outside of the vacuum container, wherein said ground switch, said switch and said conductors are accommodated in the said vacuum container;

said ground switch, and said external connecting conductors are electrically connected in said vacuum container; and said openings of said cylindrical body being air-tightly sealed with a pair of lids to constitute the vacuum container, the lids being welded to the cylindrical body after assembly and inspection of the parts in the vacuum container.

2. The vacuum switchgear according to claim 1, wherein the switch includes at least two switches of a load switch, a circuit breaker and a disconnector, whereby each of the switch functions as its switch.

3. The vacuum switchgear according to claim 1, wherein the cylindrical body of the vacuum container is press-shaped into desired shape.

4. The vacuum switchgear according to claim 1, wherein the cylindrical body of the vacuum container is constructed by a plurality of divided cylindrical bodies, and the bodies are arranged side by side, the adjoining cylinder bodies being united by welding.

5. A vacuum switch comprising an electro-conductive vacuum container to be grounded, a ground switch, a load switch, and an external connecting conductor electrically connected to the outside of the vacuum container, wherein said ground switch, said load switch and said conductor that are electrically isolated from the vacuum container are provided in said vacuum container; said ground switch and said external connecting conductor are electrically connected in said vacuum container; wherein said vacuum container is constituted by a cylindrical hollow body having openings at both ends thereof, the diameter of the openings being nearly the diameter of the cylindrical body and lids each being joined to each of said openings.

6. The vacuum switchgear according to claim 5, wherein electrodes of said ground switch and said load switch are observed through the openings after the parts and switches are assembled in the vacuum container.

7. The vacuum switchgear according to claim 5, wherein the cylindrical body is plastic-formed into a desired shape.

8. The vacuum switchgear according to claim 5, a movable electrode of said ground switch and said load switch are disposed in bellows; said bellows being inserted and joined into recesses formed on the upper surface of said cylindrical body.

* * * * *